US005136985A

United States Patent [19]

Krowech

[11] Patent Number: 5,136,985

[45] Date of Patent: Aug. 11, 1992

[54] BOILER TUBE SUPPORT

[75] Inventor: Robert J. Krowech, St. Louis Park, Minn.

[73] Assignee: Deltak Corporation, Minneapolis, Minn.

[21] Appl. No.: 758,026

[22] Filed: Sep. 12, 1991

[51] Int. Cl.[5] ..... F22B 37/24

[52] U.S. Cl. ..... 122/510; 122/511; 122/512; 165/162; 248/68.1

[58] Field of Search ..... 122/510, 511, 512; 165/162, 171, 172; 248/68.1

[56] References Cited

U.S. PATENT DOCUMENTS

| | | | |
|---|---|---|---|
| 3,785,026 | 1/1974 | Ohmstede | 29/157.4 |
| 3,856,244 | 12/1974 | Menshen | 248/68.1 X |
| 4,030,540 | 6/1977 | Roma | 122/510 X |
| 4,167,211 | 9/1979 | Haller | 165/162 X |
| 4,224,721 | 9/1980 | Ohlson | 248/68.1 X |
| 4,414,923 | 11/1983 | Csathy et al. | 122/7 R |
| 4,431,152 | 2/1984 | Reed, Jr. | 248/68.1 X |
| 4,685,426 | 8/1987 | Kidaloski et al. | 122/214 |
| 4,756,278 | 7/1988 | Fournier | 122/511 |

*Primary Examiner*—Edward G. Favors
*Attorney, Agent, or Firm*—Quarles & Brady

[57] ABSTRACT

An assembly ties together a plurality of boiler tubes to increase their mechanical stability and maintain a uniform spacing between adjacent tubes. A tie bar has a plurality of periodically spaced fingers extending from a cross member to form openings between adjacent fingers with in which the boiler tubes tightly fit. A retainer projects orthogonally from ends of some of the fingers. A locking bar has wedges spaced along one edge which engage the retainers clamping the boiler tubes between the fingers of said locking bar. Stops and brackets attach to the boiler tubes to support the fingers and cross member, thereby holding the tie bar in place during assembly.

13 Claims, 2 Drawing Sheets

BOILER TUBE SUPPORT

BACKGROUND OF THE INVENTION

The present invention relates to heat exchangers in which a fluid passing through a series of tubes is heated by hot gases flowing around the tubes; and more particularly to devices for tieing the tubes together for increased mechanical stability.

As shown in FIG. 1, a conventional heat exchanger 10, such as a boiler, superheater, economizer or air heater, has a chamber 12 through which pass exhaust gases from the combustion process. The gases enter one end 13 of the chamber 12 and flow out of an opposite end 14. A plurality of metal tubes 16 extend across the interior of the chamber transverse to the direction of the gas flow. Depending upon the gas flow direction each tube extends horizontally or vertically with a vertical orientation being illustrated. The tubes are bundled closely to one another in a two-dimensional matrix to maximize the heat transfer. The ends of adjacent tubes 16 are coupled together to form a coil through which water flows. Heat is transferred from the exhaust gases passing around the tubes into the water, converting the water from a liquid state to a gaseous state, or steam.

In industrial boilers, the chamber 12 is very large and the length of tubes 16 relatively long, for example forty feet in length. To maximize the heat transfer, the tubes are bundled closely to one another. The gas flow causes the relatively long tubes to vibrate, which if left unrestricted, causes excessive mechanical wear and generates noise.

To overcome these problems, the vibration is reduced by adding intermediate supports across each line of tubes to provide additional stiffness, thereby inhibiting flow induced vibration. Previously, intermediate tube supports consisted of a metal rod or bar welded transversely to each tube, thereby tying them together across the tube bundle. The supports also maintain even spacing between the tubes 16 by preventing deflection in the midsection of the chamber 12. It is desirable to maintain the tubes in a uniform matrix to provide efficient soot blowing and predictable heat transfer within the boiler. In addition, the tube supports often are used to transmit mechanical shock from a rapper to intentionally vibrate the tubes for periodic cleaning of deposits.

Quite often the exhaust gases from the combustion process are corrosive and attack the metal tube supports. It is not uncommon that the tube supports disintegrate or break loose from the tubes due to the corrosive environment within the chamber. Because of the compactness of the tube bundle and the fact that the supports were welded to each tube, previous supports could not be replaced easily without disassembly of a major portion of the boiler.

It is therefore desirable to have an intermediate tube support which will rigidly hold each tube across the bundle while permitting easy replacement if corrosion occurs.

SUMMARY OF THE INVENTION

A device is provided to mechanically connect a plurality of cylindrical members, such as a coplanar array of tubes in a boiler. The device includes a tie bar formed by a plurality of fingers extending from and spaced periodically along a cross member to receive a cylindrical member between adjacent fingers. A separate retainer extends transversely from the distal ends of at least some of the fingers to engage a locking bar.

The locking bar has wedge shaped projections spaced along one edge to engage the retainers and securely clamp the cylindrical members between the locking bar and the tie bar cross member.

Preferably the device also includes a stop which can be attached to a cylindrical member for supporting a finger of said tie bar. In addition a support can be provided for attaching the a cylindrical member to guide the tie bar. Both the stop and the support guide and carry components of the device during assembly on the cylindrical members.

DETAILED DESCRIPTION OF THE INVENTION

Figure 2:
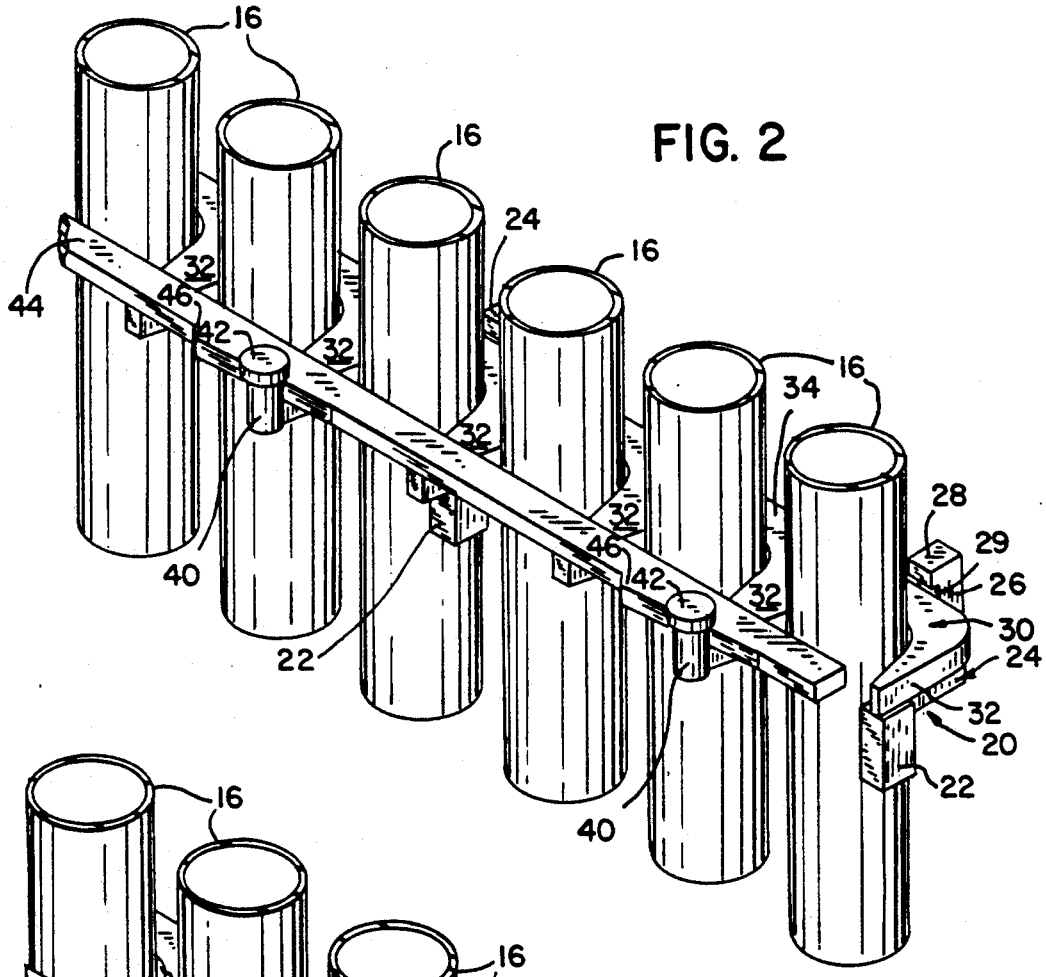
FIG. 2 illustrates a bundle of boiler tubes connected by an intermediate support according to the present invention.

With reference to FIG. 2 a plurality of cylindrical boiler tubes 16 are connected by a support, or tube tie, 20 according to the present invention. A relatively small segment of the support 20 attached to a few short sections of tubes 16 have been shown for ease of illustration. For example in a common arrangement, thirty tubes are placed in a plane across a typical boiler chamber 10 and are interconnected by one support 20.

Figure 1:
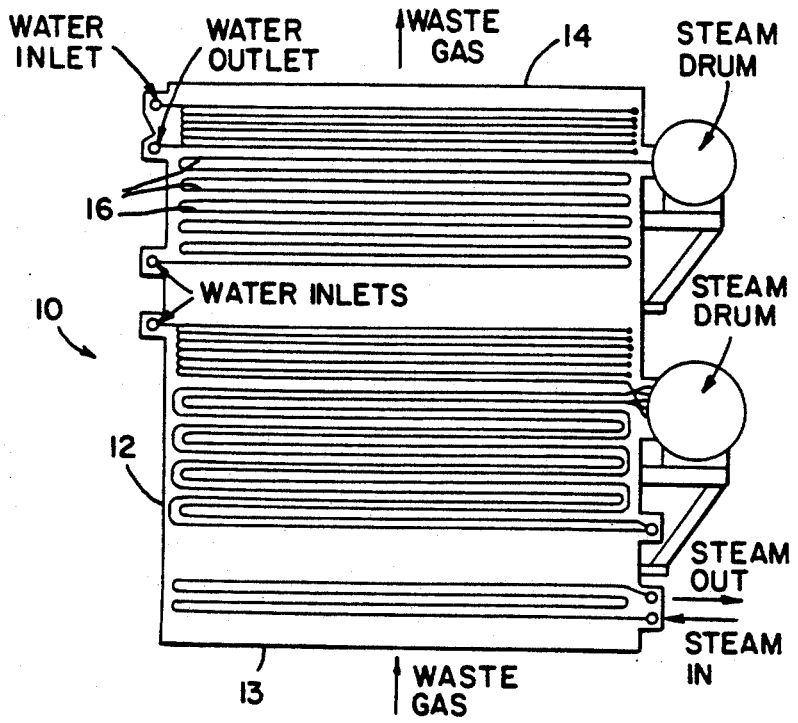
FIG. 1 is a diagram of tube assemblies within a boiler.
Figure 3:
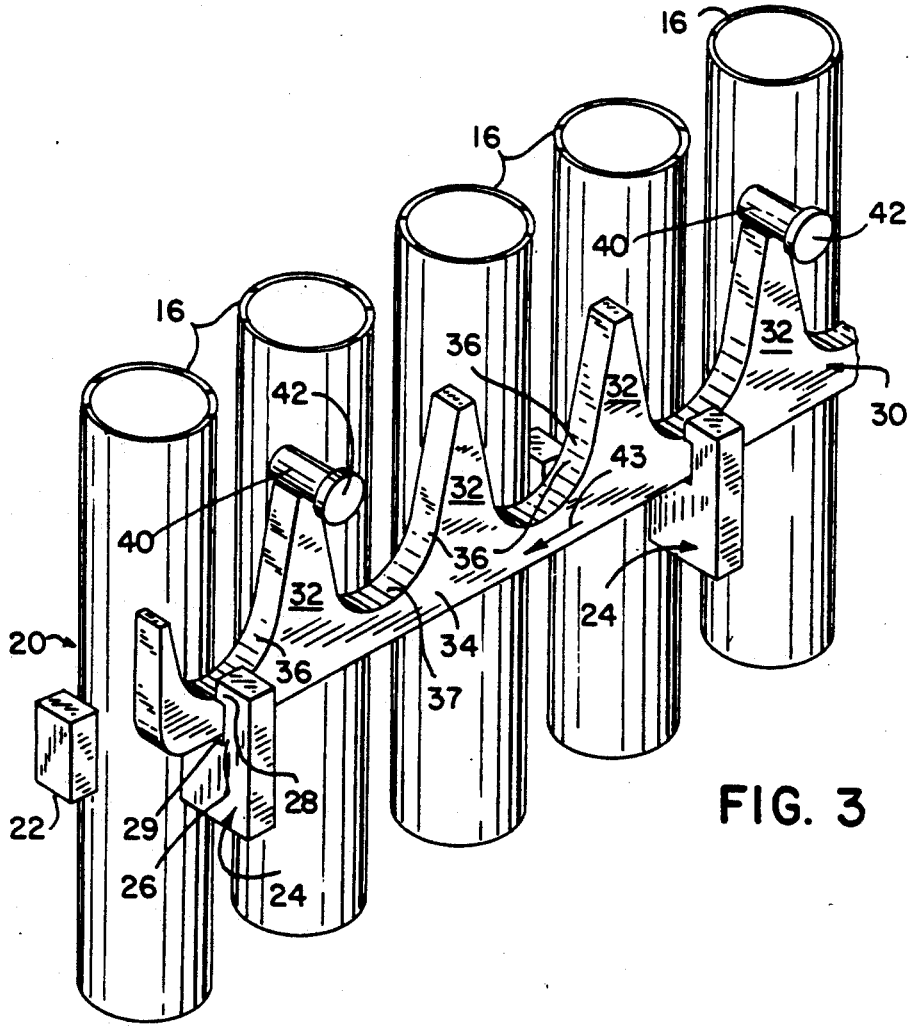
FIGS. 3 and 4 illustrate different steps in the assembly of the support onto a set of boiler tubes.

Tube support 20 is formed with a separate stop 22 attached to every third tube 16 in the coplanar group. The stops 22 are aligned with one another along the length of the tubes and are positioned between adjacent tubes 16. The stop in its simplest form is a rectilinear block of metal which can be welded to the tubes. A bracket 24 also is welded to every third tube on one side of the group. However, the stops 22 and brackets 24 may be spaced more or less frequently across the group of tubes 16. As shown in FIG. 3, the bracket 24 has a projection 26 extending parallel to the length of the tube 16 with a tooth 28 projecting toward the tube from the distal end of projection 26. This configuration forms a notch 29 between the projection 26 and the attached tube 16.

Referring to FIGS. 2 and 3, a tie bar 30 has a plurality of spaced apart fingers 32 extending orthogonally from a cross member 34. The fingers are spaced to fit between adjacent tubes. The width of each finger 32 diminishes, or tapers, going away from the cross member 34. Tapered U-shaped openings 36 are formed between adjacent fingers 32 in which the width of the opening diminishes going along the fingers toward the cross member 34. The transverse portion 37 of each U-shaped opening 36 is curved at a radius which is approximately equal to the outer radius of a boiler tube 16.

A separate retainer pin 40 is welded to the tip of every third finger 32. Each retainer pin 40 has a cylindrical shaft and has a larger diameter head 42 at one end of the shaft spaced from the finger 32. Alternatively, at least some of the fingers 32 could be made longer with the additional portion being bent a right angles, thereby acting as the retainer eliminating the need for a separate pin 40.

As shown in FIG. 3, the tie bar 30 is assembled onto the tubes 16 by turning it on edge and sliding the bar from one end of a group of tubes in a direction indicated by arrow 43. The tie bar 30 travels against the tubes so that the cross member 34 passes between the tooth 28 on brackets 24 and the associated tube 16 resting in notch 29. The fully inserted tie bar 30 then is tilted downward so that its fingers 32 pass between adjacent tubes 16 until the fingers strike the stops 22 in a position shown in FIG. 4. The inwardly tapering U-shaped openings guide fingers 32 between adjacent tubes 16 during assembly.

The tie bar 30 is positioned so that one of the boiler tubes 16 fits snugly between each pair of adjacent fingers 32. The fingers 32 restrict lateral movement of the boiler tubes. The cross member 34 of the tie bar 30 rests in the notches 29 of the brackets 24 and every third finger 32 rests on a stop 22 welded to the tubes. This support mechanism captivates the tie bar 30 in place during the assembly process.

Figure 4:
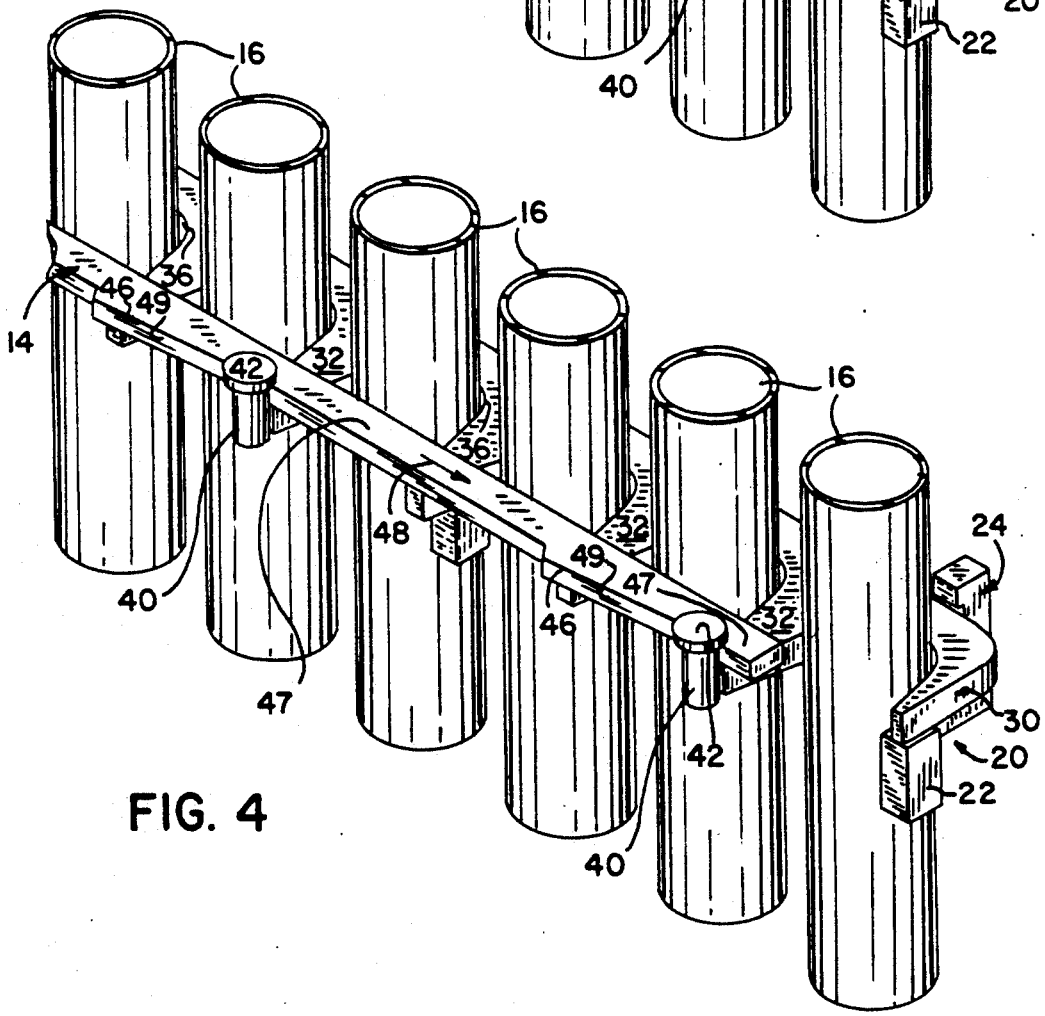

A locking bar 44 pulls the tie bar 30 against the tubes so that the tubes nest tightly in the U-shaped openings 36 between the fingers 32. The locking bar 44 has generally straight sides with longitudinally extending wedge elements 46 periodically located along an outer edge. The spacing of the wedges 46 coincides with the spacing of the retainer pins 40 on the fingers of the tie bar 30. During the assembly process, the narrower segments 47 of the locking bar between wedge elements 46 are inserted between the retainer pins 40 and the tubes 16 as illustrated in FIG. 4. The locking bar 44 then is driven longitudinally as indicated by arrow 48 so that the tapered surface 49 of each wedge element 46 engages one of the retainer pins 40. The cylindrical shape of the retainer pins 30 present a minimal surface area of contact with the locking bar 44, thereby reducing the friction during the assembly process. This action pulls the tie bar 30 toward the tubes 16 so that the tubes abut the curved portion of the U-shaped openings 36 between the fingers 32 to firmly grip the tubes as shown in FIG. 2. In the final assembled state shown in FIG. 2, the locking bar 44 is wedged between the tubes 16 and the tie bar pins 40. One end of the locking bar is welded either to an outside finger of the tie bar 30 or to the outermost tube 16. Other means of fixing the locking bar 44 in place can be used as long as the attachment can be disconnected for subsequent removal of the tie and locking bars. If a subsequent inspection of the tube assemblies within the boiler indicates that a support 20 is beginning to corrode extensively, the support can be replaced. An installed tube support 20 is removed by reversing the assembly process. Specifically, force is exerted on an end of the locking bar 44 to move it in the opposite direction to arrow 48. Once the locking bar 44 has been moved so that narrow segments 47 fall between the retainer pins 40 and the tubes 16, the locking bar can be tilted on edge and pulled out of the tube assembly. Next, the tie bar 30 then can be tilted into a vertical position as shown in FIG. 3 and removed from the tube assembly by pulling it over the brackets 24. A new set of tie and locking bars then can be installed.

The stops 22 and brackets 24 aid in positioning the tie bar 30 across the coplanar group of tubes 16 during the assembly process, as well as aiding subsequent removal of the tie bar. The large heads 42 on the retainer pins 40 guide the locking bar 44 into position. In FIG. 4, the locking bar 44 is captivated by the pins 40 and prevented from rising off the fingers 32 of the tie bar 30 during the assembly process.

The present support 20 rigidly holds each of the boiler tubes 16 in a fixed position with respect to each other, reducing vibrational movement of the tubes and maintaining the tubes in a fixed relationship to one another. During maintenance of the boiler, a rapper can be used to strike one end of the support which transfers mechanical energy to each of the tubes to loosen any deposits which may have built up in both the inside and outside the tube.

I claim:

1. A boiler comprising:
a housing which forms a chamber;
a plurality of boiler tubes within the chamber;
a tie bar mounted on the tubes and having a plurality of fingers extending from and spaced periodically along a cross member to form an opening between adjacent fingers within which a boiler tube is located, and having a retainer projecting from at least some of the fingers;
a locking bar having wedge elements spaced along one edge for removably engaging the retainers and an opposite edge abutting said boiler tubes; and
a support means attached to at least some of said boiler tubes and engaging said tie bar.

2. The boiler as recited in claim 1 wherein said support means comprises a stop attached between a pair of adjacent boiler tubes and abutting a finger of said tie bar.

3. The boiler as recited in claim 1 wherein said support means comprises a bracket having a body attached to a boiler tube and a projection extending from the body to guide said tie bar.

4. The boiler as recited in claim 1 further wherein each retainer comprises a cylindrical body attached to a finger of said tie bar, and a head at one end of said cylindrical body to captivate said locking bar between the head and the finger.

5. An device for connecting a plurality of tubes comprising:
a tie bar having a plurality of fingers extending in a first direction from and spaced periodically along a cross member to receive a tube between adjacent fingers, and having a separate retainer projecting from at least some of the fingers in a second direction transverse to the first direction; and
a locking bar having wedge elements spaced along one edge for engaging the retainers and clamping the tubes between said locking bar and the cross member of said tie bar.

6. The device as recited in claim 5 further comprising a stop for attaching to a tube to engage a finger of said tie bar.

7. The device as recited in claim 5 further comprising a bracket for attaching to a tube to engage said tie bar.

8. The device as recited in claim 7 wherein said bracket comprises a body having a surface adapted to abut a tube, and a projection extending from the body to retain said tie bar adjacent the tubes during assembly.

9. The device as recited in claim 8 wherein said bracket further comprises a tooth extending from said projection to captivate said tie bar adjacent a tube.

10. The device as recited in claim 5 further wherein the retainers comprise a body attached to an end of a finger of said tie bar with a head at one end of the body.

11. The device as recited in claim 5 further wherein each retainer comprises a cylindrical body attached to a finger of said tie bar, and a head at one end of the body and spaced from said finger to permit the edge of said locking bar to fit therebetween.

12. The device as recited in claim 5 further wherein each finger is tapered to narrow going away from the cross member.

13. An device for connecting a plurality of tubes comprising:

a tie bar having a plurality of fingers from and spaced periodically along a cross member to receive a tube between adjacent fingers, and having a separate retainer projecting from at least some of the fingers; and a locking bar having wedge elements spaced along one edge which removably engage the retainers and clamp the tubes between said locking bar and the cross member of said tie bar.

* * * * *